US009404266B2

(12) United States Patent
Yildiz

(10) Patent No.: US 9,404,266 B2
(45) Date of Patent: Aug. 2, 2016

(54) COVERED GUTTER SYSTEM

(71) Applicant: Ozcan Yildiz, Quakertown, PA (US)

(72) Inventor: Ozcan Yildiz, Quakertown, PA (US)

( * ) Notice: Subject to any disclaimer, the term of this patent is extended or adjusted under 35 U.S.C. 154(b) by 0 days.

(21) Appl. No.: 14/291,262

(22) Filed: May 30, 2014

(65) Prior Publication Data

US 2015/0345144 A1 Dec. 3, 2015

(51) Int. Cl.
*E04D 13/00* (2006.01)
*E04D 13/076* (2006.01)

(52) U.S. Cl.
CPC ..... *E04D 13/076* (2013.01)

(58) Field of Classification Search
CPC ..... E04D 13/076; E04D 13/064
USPC ..... 52/11–16
See application file for complete search history.

(56) References Cited

U.S. PATENT DOCUMENTS 1,639,916 A * 8/1927 Wilson ..... 248/48.2
5,575,118 A * 11/1996 Vahldieck ..... 52/11
6,701,674 B1 * 3/2004 Albracht ..... E04D 13/0725 52/11
2003/0041528 A1 * 3/2003 Vahldieck ..... 52/15
2005/0108951 A1 * 5/2005 McDonald et al. ..... 52/11
2007/0044387 A1 * 3/2007 Herrera ..... 52/12
2007/0220814 A1 * 9/2007 Faulks ..... 52/12
2009/0090067 A1 * 4/2009 Demartini ..... 52/12
2010/0242376 A1 * 9/2010 Dowling et al. ..... 52/12
2011/0126477 A1 * 6/2011 Hurn ..... 52/12
2012/0222366 A1 * 9/2012 Steinberg et al. ..... 52/12

* cited by examiner

*Primary Examiner* — Brian Glessner
*Assistant Examiner* — Gisele Ford
(74) *Attorney, Agent, or Firm* — Danielson Legal LLC

(57) ABSTRACT

A gutter system having a gutter body including a cover surface extending from a rear edge to a forward edge, a return surface extending from a rear edged to a forward edge, and a channel portion including a rear wall, a forward wall and a channel portion therebetween whereby the channel portion defines a collection chamber. The cover surface forward edge and the return surface forward edge meet at a curved wicking edge. The return surface rear edge is connected to an upper edge of the rear wall and the forward wall terminates at an upper edge spaced from the wicking edge to define a water receiving gap.

17 Claims, 3 Drawing Sheets

Fig. 4
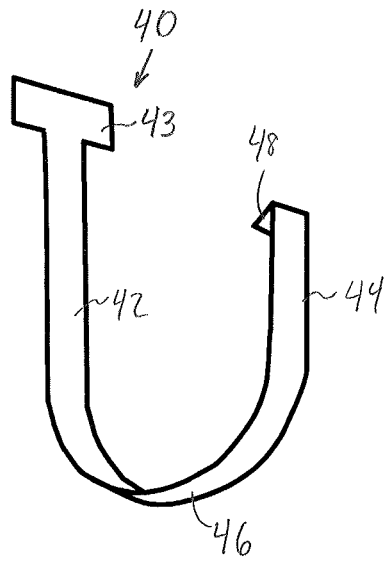
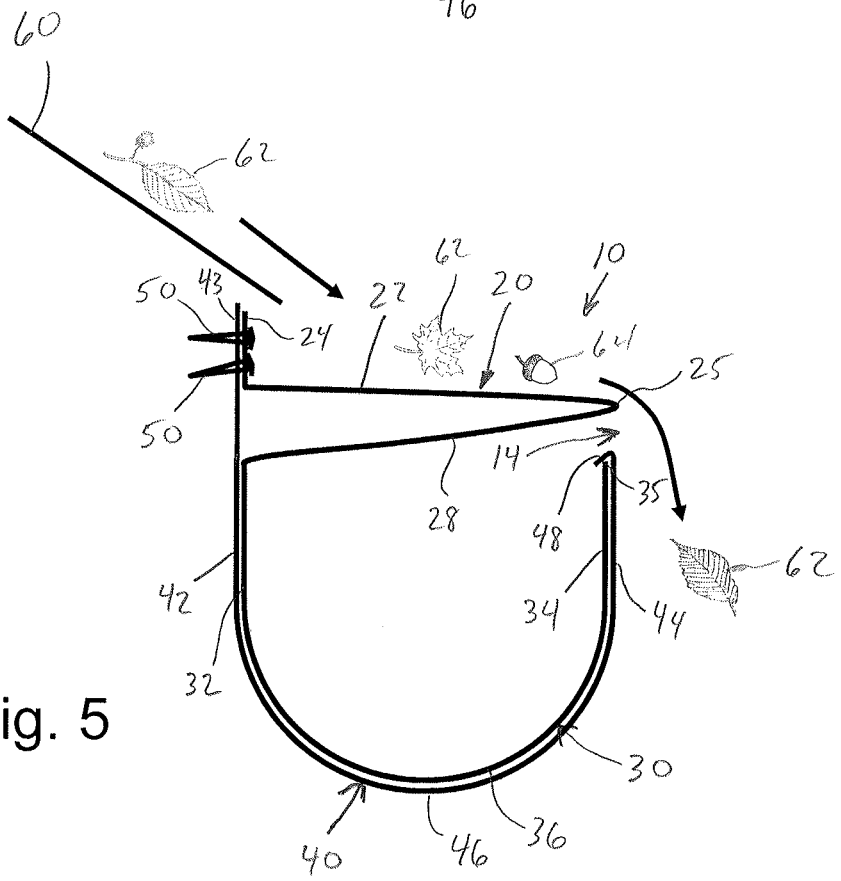
Fig. 5

COVERED GUTTER SYSTEM

FIELD OF THE INVENTION

This invention relates to a gutter system for collecting rain water. More particularly it relates to a rain gutter system for receiving water run-off in preference to leaves and other debris.

BACKGROUND OF THE INVENTION

Rain gutters for collecting rain runoff from pitched building roofs are generally U-shaped open troughs that are arranged along the roofline of the building, and in are oriented to catch the surface water that runs off from the roof and guide it to a downspout. Such gutters are usually connected to a fascia board on the building and include one or more downspouts to carry away the roof water runoff and direct it in a desired direction away from the building.

Rain gutters typically are open in an upward direction and will collect leaves and other wind-blown debris, in addition to the rainwater runoff from the roof. The accumulation of leaves and other debris within the gutter ultimately leads to gutter and downspout opening clogging, thereby causing undesired gutter overflow over the front edge of the gutter and along the adjacent building wall. Restoration of the proper water collection and disposal function of such upwardly-open gutters requires that the collected leaves and debris be manually removed, an operation that usually requires climbing a ladder and physically removing the collected matter, which is a tedious, time-consuming process, and one that is potentially dangerous because it involves climbing a ladder to the building roof line and could lead to a fall from the ladder.

Various gutter arrangements have been proposed and developed over the years in an effort to solve the rain-gutter-cleaning problem by blocking the entry into the gutter of leaves and debris. One approach involves the installation over the gutter top opening of a screen or mesh material. The screen or mesh has a number of small openings that are so sized as to allow water to enter the gutter trough while screening out or blocking leaves and other debris from entering the gutter. However, many such screening arrangements have the screening element positioned horizontally over the gutter top opening, or at a very slight inclination, thereby allowing the collection of leaves and debris on the surface of the screening, leading to external gutter clogging rather than internal gutter clogging. Further, the stems of leaves often extend into the screening openings, thereby serving to retain the leaves on the surface of the screening material, preventing their being blown off by the wind, and leading to partial or complete blockage of the screen surface and preventing the full flow of roof runoff to the downspout openings in the gutter base panel.

Another approach that has been developed to block the entry into gutters of leaves and debris is a flat cover that overlies the gutter top opening. The cover is intended to serve as a deflector of leaves and other debris so that they either are blown off the cover by the wind, or they fall over the front edge of the gutter, while allowing the rain water to flow over and around the outer edge of the cover and into the gutter for collection and disposal. Although several approaches to configuring and supporting a gutter cover have been disclosed, those approaches are either cumbersome and time consuming from an installation standpoint, are costly in terms of the amount of attachment materials needed, or are not particularly rigid in terms of the rigidity of the overall gutter structure or the rigidity of its attachment to a building surface.

Accordingly, there is a need for an improved rain gutter system with a cover for deflecting leaves and debris from entering the gutter trough.

SUMMARY OF THE INVENTION

In at least one embodiment, the present invention provides a gutter system having a gutter body including a cover surface extending from a rear edge to a forward edge, a return surface extending from a rear edged to a forward edge, and a channel portion including a rear wall, a forward wall and a channel portion therebetween whereby the channel portion defines a collection chamber. The cover surface forward edge and the return surface forward edge meet at a curved wicking edge. The return surface rear edge is connected to an upper edge of the rear wall and the forward wall terminates at an upper edge spaced from the wicking edge to define a water receiving gap.

In at least one embodiment, the cover surface and the return surface define a self-supporting cantilevered structure.

In at least one embodiment, the gutter system includes a plurality of external hanging clips configured to support the gutter body.

In at least one embodiment, the gutter system is manufactured as a seamless gutter.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings:

FIG. 4 is a perspective view of an exemplary hanging clip of the gutter system of FIG. 1.

FIG. 5 is an elevation view along the line 2-2 in FIG. 1.

DETAILED DESCRIPTION OF THE INVENTION

Figure 1:
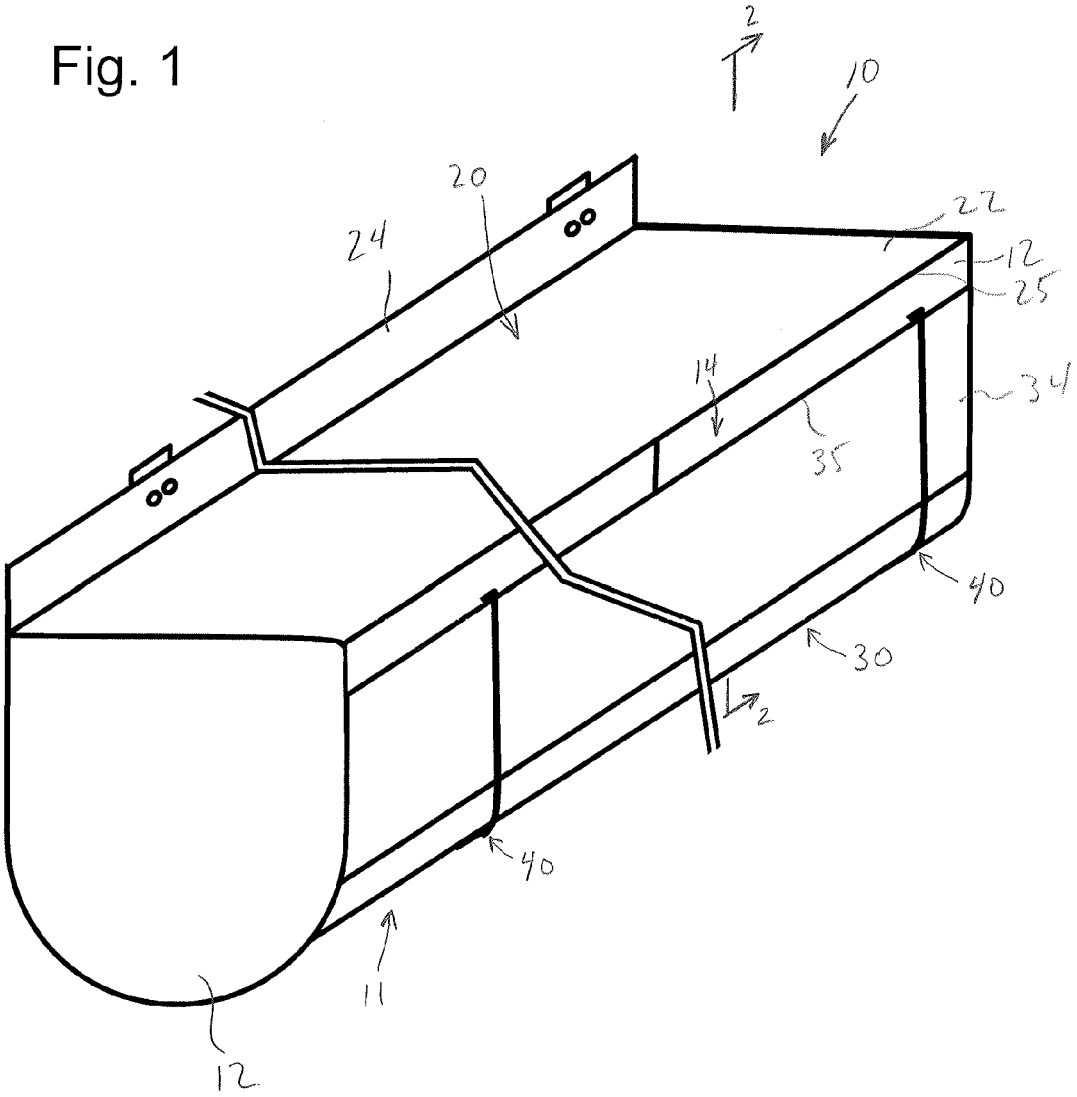
FIG. 1 is a perspective view of an exemplary gutter system in accordance with an embodiment of the invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
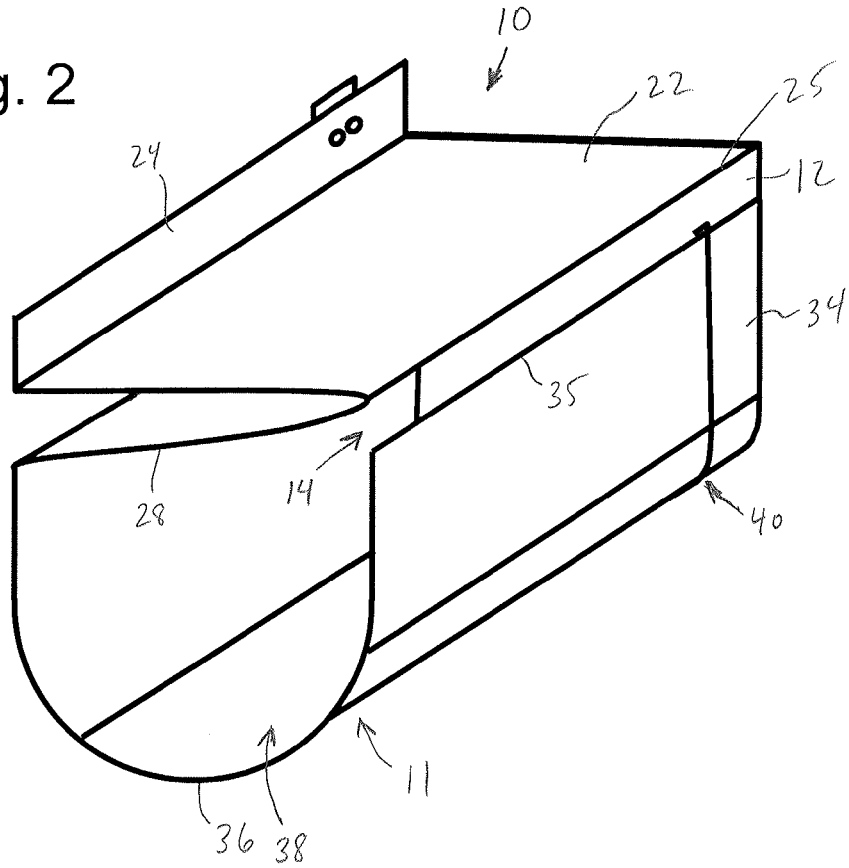
FIG. 2 is a perspective cross-sectional view along the line 2-2 in FIG. 1.
Figure 3:
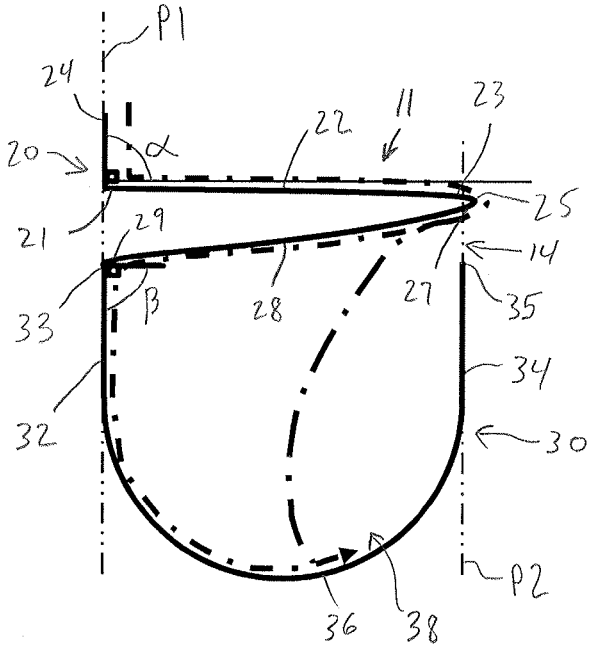
FIG. 3 is an elevation view of an exemplary gutter body in accordance with an embodiment of the invention.

Referring to FIGS. 1-5, an exemplary embodiment of a gutter system 10 in accordance with an exemplary embodiment of the invention will be described. With reference to FIGS. 1-3, the gutter system 10 includes gutter body 11 defining a channel portion 30 and a cover portion 20 with a water receiving gap 14 therebetween. An end cap 12 extends along each lateral end of the gutter system 10 whereby the end caps 12 close the lateral ends of the channel portion 30. The end caps 12 are preferably crimped or otherwise sealingly interconnected along the cover portion 20. The body 11 of the gutter system 10 is preferably a seamless assembly and can be formed to any desired length. While the illustrated gutter system 10 includes a straight configuration, it is recognized that the gutter system 10 may be formed with internal or external corners or the like. In the preferred embodiment, the gutter system 10 includes external hanging clips 40 which will be described in more detail hereinafter.

Referring to FIGS. 2 and 3, the gutter body 11 in accordance with an exemplary embodiment of the invention will be described. The gutter body 11 includes a cover surface 22 of the cover portion 20 which extends from a rear edge 21 to a forward edge 23. A connection flange 24 extends upward from the rear edge 21 of the cover surface 22 and extends in a plane P1.

A wicking edge 25 is defined along the forward edge 23 of the cover surface 22 and connects to a forward edge 27 of a return surface 28. The return surface 28 extends from the forward edge 27 to a rear edge 29 which interconnects with an upper edge 33 of the rear wall 32 of the channel portion 30. The rear wall 32 preferably extends in the plane P1 such that it is co-planar with the flange 24. A bottom channel surface 36 interconnects the rear wall 32 with a forward wall 34 to define a collection chamber 38. While the channel portion 30 is illustrated as having a semi-circular shaped configuration, it is not limited to such and may have other configurations, for example, U-shaped, triangular, trapezoid, square, rectangular or elliptical.

The forward wall 34 extends to an upper edge 35 which is spaced from the wicking edge 25 to define the water receiving gap 14. The gap 14 is generally narrow, for example, approximately ½ inch in width, which prevents larger objects from entering into the collection chamber 38. The configuration of the gutter body 11 further contributes to collection of rain while preventing passage of leaves or debris into the collection chamber 38.

Referring to FIG. 3, the cover surface 22 preferably extends in a plane at an obtuse angle $\alpha$ relative to the flange 24 such that the cover surface 22 is sloped downwardly from the rear edge 21 to the forward edge 23. The return surface 28 preferably extends at an obtuse angle $\beta$ with respect to the rear wall 32 such that it slopes downwardly from the front edge 27 to the rear edge 29. The wicking edge 25 defines a curved surface between the cover surface 22 and the return surface 28. With this configuration, rain water on the cover surface 22 naturally rolls to the forward edge 23, wicks around the wicking edge 25 and onto the return surface 28 where it is directed to the rear wall 32 and into the collection chamber 38 of the channel portion 30, as indicated by the dashed arrow in FIG. 3. The curvature of the wicking edge 25 causes leaves or other large debris to fall away from the gap 14, as the wicking force will not be sufficient to cause such objects to travel along the return surface 28. To further promote larger objects from falling away from the gap 14, the cover portion 20 may be configured such that the wicking edge 25 extends forwardly of the plane P2 of the front wall 34, as illustrated in FIG. 3. It is contemplated that the wicking edge 25 may be formed even with or even rearwardly of the plane P2, for example, in cases where the gap 14 has a very minimal width.

Referring to FIGS. 4 and 5, an exemplary method of hanging the gutter system 10 will be described. The gutter system 10 is supported by a plurality of external hanging clips 40. Each of the exemplary hanging clips 40 includes a mounting portion 42 with a head 43, a channel support portion 46, and a retaining portion 44 with a retaining lip 48. The channel support portion 46 preferably has a configuration which complements the configuration of the channel portion 30. As described below, in a preferred method of mounting, fasteners 50 are secured directly through the head 43 of the mounting portion 42 without any holes. It is contemplated that the head 43 or mounting portion 42 may define one or more holes.

Referring to FIG. 5, in the illustrated embodiment, a plurality of clips 40 are positioned on the gutter body 11 by positioning the retaining lip 48 of each clip 40 into the gap 14 such that it secures about the upper edge 35 of the front wall 34 and then rotating the clip 40 about the gutter body 11 until the head 43 is positioned adjacent the flange 24. The gutter system 10 is positioned along a roof 60 line or the like and fasteners 50 are secured through the flange 24 and the head 43 of the hanging clip 40 to secure the gutter system 10. While the illustrated embodiment shows the fastener 50 passing through the flange 24 and the hanging clip 40, it is contemplated that additional fasteners may be secured through the flange without passing through a clip 40.

In an alternative method, the clips 40 may be secured to the building structure first and then the gutter body 11 rotated into a supported position within the clips 40. Once positioned, fasteners 50 would again be secured through the flange 24 and the clip heads 43. The illustrated hanging clips 40 have a J-shape, however, other configurations may be utilized, provided the clip supports the channel portion 30 and prevents forward movement thereof.

With reference to FIG. 5, the external hanging clips 40 support the channel portion 30 and the fasteners 50 secure the flange 24 of the cover portion 20. With such support, the cover surface 22 and return surface 28 define a self-supporting cantilever structure. Such a self-supporting structure eliminates the need for internal support brackets found in many of the prior-art covered gutter systems. Such internal support brackets add to the expense of those systems, are often difficult to install and/or maintain, and may cause blockage within the collection chamber. The gutter system of the current invention eliminates the need for such internal support structures.

As illustrated in FIG. 5, leaves 62, acorns 64, shingle sand and the like may pass from the roof 60, onto the cover surface 22, but then will fall off of the front of the gutter system 10 without passing through the water receiving gap 14. Additionally, the gap 14 prevents birds, squirrels and the like from entering the collection channel 38 or nesting within the channel 38. The self-supporting cantilever structure also helps to ensure that ice and snow which slides down the roof 60 will simply pass along the cover surface 22 and away from the gutter system 10 without damage thereto.

It is noted that the while the illustrated gutter body 11 is formed from a seamless, single sheet of material, such is not required. It is recognized that the cover portion and the channel portion may be formed separately and interconnected. It is further recognized that the cover surface and return surface may be formed separately and interconnected.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A gutter comprising:

a monolithic gutter body including:

a channel portion including a rear wall, a forward wall and a bottom channel surface therebetween whereby the channel portion defines a collection chamber;

a cover surface extending from a cover surface rear edge to a cover surface forward edge, a flange co-planar to the rear wall that extends along the cover surface rear edge and terminates in a free end extending away from the channel portion, the flange comprising at least one fastener receiving hole;

a return surface extending from a return surface rear edge to a return surface forward edge; and wherein the cover surface forward edge and the return surface forward edge meet at a curved wicking edge and the return surface rear edge is connected to an upper edge of the rear wall and the forward wall terminates at an upper edge spaced from the wicking edge to define a water receiving gap and wherein the return surface extends at an obtuse angle slightly greater than 90° relative to the rear wall, and wherein the water receiving gap has a width of one-half inch or less.

2. The gutter according to claim 1, wherein the gutter body is supported by a plurality of external hanging clips.

3. The gutter according to claim 2, wherein each hanging clip includes a mounting portion, a channel support portion, and retaining portion configured to engage a portion of the forward wall.

4. The gutter according to claim 3, wherein the retaining portion includes a retaining lip configured to extend into the water receiving gap and engage the upper edge of the forward wall.

5. The gutter according to claim 1, wherein the cover surface extends at an obtuse angle relative to the flange.

6. The gutter according to claim 1, wherein a pair of end caps seal opposed lateral ends of the collection chamber.

7. The gutter according to claim 6, wherein the end caps seal opposed lateral ends of the cover surface.

8. The gutter according to claim 1, wherein the gutter body is manufactured from a single sheet of material.

9. The gutter according to claim 1, wherein the cover surface and the return surface define a self-supporting cantilevered structure.

10. The gutter according to claim 1, wherein the wicking edge extends forwardly of a plane of the forward wall.

11. The gutter according to claim 1, wherein the wicking edge is co-planar with a plane of the forward wall.

12. The gutter according to claim 1, wherein the wherein the obtuse angle at which the return surface extends relative to the rear wall is less than 100°.

13. The gutter according to claim 1, wherein an angle between the cover surface and the return surface is 15° or less.

14. A gutter comprising:

a monolithic gutter body including:

a channel portion including a rear wall, a forward wall and a bottom channel surface therebetween whereby the channel portion defines a collection chamber;

a cover surface extending from a cover surface rear edge to a cover surface forward edge, a flange co-planar to the rear wall that extends along the cover surface rear edge and terminates in a free end extending away from the channel portion, the flange comprising one or more fastener receiving holes;

a return surface extending from a return surface rear edge to a return surface forward edge; and wherein the cover surface forward edge and the return surface forward edge meet at a curved wicking edge and the return surface rear edge is connected to an upper edge of the rear wall and the forward wall terminates at an upper edge spaced from the wicking edge to define a water receiving gap and wherein the distance between the cover surface rear edge and the return surface rear edge, measured in a plane parallel to the rear wall, is less than a height of the rear wall.

15. The gutter according to claim 14, wherein the distance between the cover surface rear edge and the return surface rear edge, measured in a plane parallel to the rear wall, is less than or equal to one half of the height of the rear wall.

16. A gutter comprising:

a mounting body comprising a head, a channel support portion and a retaining lip;

a monolithic gutter body comprising:

a cover surface extending from a cover surface rear edge to a cover surface forward edge;

a return surface extending from a return surface rear edge to a return surface forward edge;

a channel portion including a rear wall, a forward wall and a bottom channel surface therebetween whereby the channel portion defines a collection chamber; and a flange co-planar to the rear wall and extending from the cover surface rear edge; and a fastener that passes through the flange of the gutter body and the head of the mounting body;

wherein the cover surface forward edge and the return surface forward edge meet at a curved wicking edge and the return surface rear edge is connected to an upper edge of the rear wall and the forward wall terminates at an upper edge spaced from the wicking edge to define a water receiving gap and wherein the flange terminates in a free end extending away from the channel portion.

17. A gutter comprising:

a monolithic gutter body comprising:

a channel portion including a rear wall, a forward wall and a bottom channel surface therebetween whereby the channel portion defines a collection chamber;

a cover surface extending from a cover surface rear edge to a cover surface forward edge, a flange co-planar to the rear wall of the channel portion, that extends along the cover surface rear edge away from the channel portion and terminates in an unengaged edge; and a return surface extending from a return surface rear edge to a return surface forward edge;

wherein the cover surface forward edge and the return surface forward edge meet at a curved wicking edge and the return surface rear edge is connected to an upper edge of the rear wall and the forward wall terminates at an upper edge spaced from the wicking edge to define a water receiving gap and wherein the return surface extends at an obtuse angle slightly greater than 90° relative to the rear wall, and wherein the water receiving gap has a width of one-half inch or less.

* * * * *